US009444145B2

(12) United States Patent
Chan

(10) Patent No.: US 9,444,145 B2
(45) Date of Patent: Sep. 13, 2016

(54) COMPACT, POLARIZATION-INSENSITIVE ANTENNA FOR HANDHELD RFID READER AND METHOD OF MAKING AND USING SAME

(71) Applicant: SYMBOL TECHNOLOGIES, INC., Lincolnshire, IL (US)

(72) Inventor: Yiu Kwong Chan, Bellport, NY (US)

(73) Assignee: Symbol Technologies, LLC, Holtsville, NY (US)

( * ) Notice: Subject to any disclaimer, the term of this patent is extended or adjusted under 35 U.S.C. 154(b) by 36 days.

(21) Appl. No.: 14/196,387

(22) Filed: Mar. 4, 2014

(65) Prior Publication Data

US 2015/0255873 A1 Sep. 10, 2015

(51) Int. Cl.
*H01Q 9/28* (2006.01)
*H01Q 1/22* (2006.01)
*H01Q 19/28* (2006.01)

(52) U.S. Cl.
CPC ..... *H01Q 9/285* (2013.01); *H01Q 1/2216* (2013.01); *H01Q 19/28* (2013.01); *Y10T 29/49016* (2015.01)

(58) Field of Classification Search
None
See application file for complete search history.

(56) References Cited

U.S. PATENT DOCUMENTS 5,914,693 A 6/1999 Takei et al.
5,952,982 A * 9/1999 Jorgenson ..... H01Q 11/10 343/792.5
8,022,827 B2 * 9/2011 Rossman ..... H01Q 1/2208 340/572.1
8,746,577 B2 * 6/2014 Bernhard et al. ..... 235/492
8,866,616 B2 * 10/2014 Ho ..... 340/572.7
2007/0023525 A1 2/2007 Son et al.
2007/0141997 A1 6/2007 Wulff et al.
2008/0088460 A1 * 4/2008 Copeland ..... 340/572.7
2009/0051539 A1 2/2009 Ho
2009/0174557 A1 * 7/2009 Nikitin ..... G06K 7/10316 340/572.7
2010/0007570 A1 1/2010 Sardariani et al.
2010/0171666 A1 7/2010 Mizutani et al.
2010/0309068 A1 * 12/2010 Duron et al. ..... 343/730
2012/0019427 A1 * 1/2012 Ishikawa et al. ..... 343/833

FOREIGN PATENT DOCUMENTS

CA 2725867 C 8/2013
KR 100750850 B1 * 8/2007
WO 2011143491 A1 11/2011

OTHER PUBLICATIONS

International Search Report and Written Opinion mailed May 18, 2015 in counterpart PCT application PCT/US2015/015549.

* cited by examiner

*Primary Examiner* — Howard Williams

(57) ABSTRACT

An antenna, especially for use with a handheld RFID reader for scanning RFID tags oriented in different orientations, includes a feeding port located on an axis for supplying an RF signal to a primary antenna member for transmitting and receiving electromagnetic waves. A secondary antenna member is juxtaposed with the primary antenna member for re-radiating the electromagnetic waves propagated by the primary antenna member. Each antenna member includes one antenna element extending in a radial direction away from the axis and continuing along at least one turn in a turning direction at least partly about the axis, and another antenna element extending in an opposite radial direction away from the axis and continuing along at least one turn in the turning direction at least partly about the axis. The electromagnetic waves have congruent slant polarizations each having components in both of two mutually orthogonal planes to read the tags.

14 Claims, 6 Drawing Sheets

COMPACT, POLARIZATION-INSENSITIVE ANTENNA FOR HANDHELD RFID READER AND METHOD OF MAKING AND USING SAME

BACKGROUND OF THE INVENTION

The present disclosure relates generally to a compact, polarization-insensitive antenna operative for transmitting or receiving electromagnetic waves in mutually orthogonal polarization planes at the same time, and to a method of making such an antenna and, more particularly, to using such an antenna with a radio frequency (RF) identification (RFID) reader, especially one configured for handheld, mobile use, for scanning RFID tags oriented at different orientations and associated with items contained in a controlled area, advantageously for inventory control of the RFID-tagged items.

RFID systems are well known and are commonly utilized for item tracking, item identification, and inventory control in manufacturing, warehouse, and retail environments. Briefly, an RFID system includes two primary components: a reader (also known as an interrogator), and a tag (also known as a transponder). The tag is a miniature device associated with an item to be monitored and is capable of responding, via a tag antenna, to an electromagnetic wave wirelessly propagated by a reader antenna of the reader. The tag responsively generates and wirelessly propagates a return electromagnetic wave back to the reader. The return electromagnetic wave is modulated in a manner that conveys identification data (also known as a payload) from the tag back to the reader. The identification data can then be stored, processed, displayed, or transmitted by the reader as needed. The return electromagnetic wave can also be used to determine the true bearing and location of the tag in a controlled area.

Due to the relatively large size and complexity of the necessary RFID components, stationary RFID readers were fixedly mounted at doorways, loading docks, and assembly lines and were the first to be developed and deployed in the field. As RFID technology matured, a need for mobile handheld RFID readers became increasingly important. Handheld RFID readers traditionally leveraged the RF antenna designs from fixed readers. However, the antenna designs for fixed readers were relatively large, heavy, costly and obtrusive, and were largely impractical for handheld reader use where compact, light, and inexpensive considerations are more important for widespread adoption.

The art has proposed various antenna designs, such as dipole antennas, for handheld RFID reader use. A dipole antenna propagates an electromagnetic wave entirely in one plane of polarization, e.g., either in a horizontal plane (horizontal polarization), or in a vertical plane (vertical polarization). The orientation of the tags in the controlled area is typically unknown, and conventional tag antennas are typically polarized in only one direction or plane: vertical or horizontal. The reader antenna and the tag antenna should be matched in polarization to obtain the best reading performance. Therefore, a horizontally polarized reader antenna is unable to accurately and quickly read a vertically polarized tag without some user manipulation or rotation of the reader and/or the tag. Likewise, a vertically polarized reader antenna is unable to accurately and quickly read a horizontally polarized tag without some user manipulation or rotation of the reader and/or the tag. However, such physical efforts slow and degrade RFID reading performance.

In practice, handheld RFID readers have traditionally needed to make significant design compromises among such factors as antenna size, antenna type, antenna performance, polarization diversity, ergonomics, and the like. For example, a circularly polarized patch antenna could be used to obtain polarization insensitivity, but at a cost in antenna gain of at least about 3 dB as compared to a linearly polarized dipole antenna. Dual dipole antennas could be used, one for each polarization, but this increases size, weight and cost. A single slanted dipole antenna could be used, but again, this increases size. Antenna gain and antenna size are proportional; hence, to obtain a desirable higher antenna gain, the antenna size must be larger, which, as noted above, is undesirable for handheld operation.

Accordingly, there remains a need for a compact, polarization insensitive, less heavy, and less costly antenna that is suitable for a handheld RFID reader for scanning RFID tags oriented at various orientations and associated with items located in a controlled area, especially for inventory control of the RFID-tagged items, as well as to a method of making and using such an antenna.

BRIEF DESCRIPTION OF THE SEVERAL VIEWS OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 2:
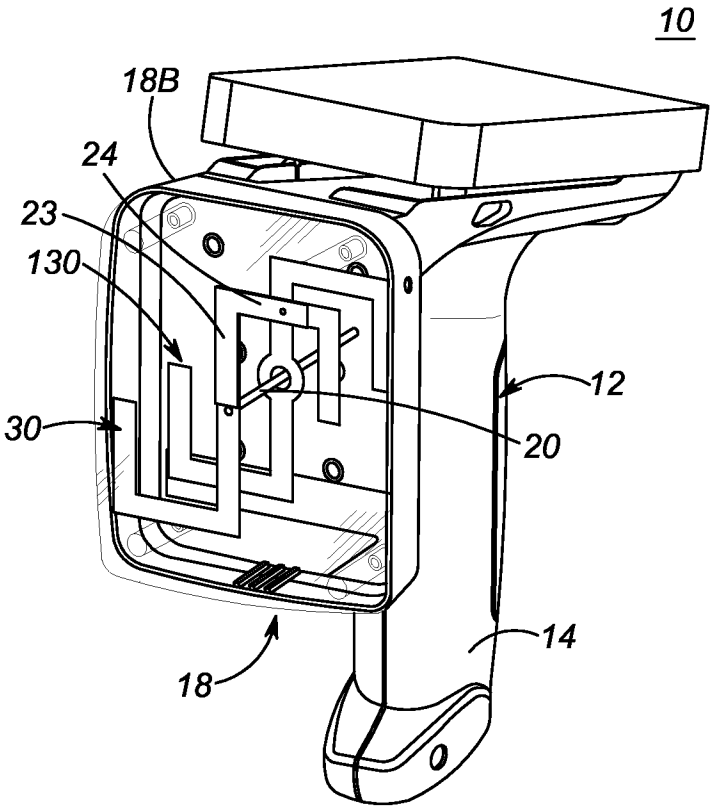
FIG. 2 is another perspective view analogous to FIG. 1, but illustrating the antenna in the interior of the radome.

Skilled artisans will appreciate that elements in the figures are illustrated for simplicity and clarity and have not necessarily been drawn to scale. For example, the dimensions and locations of some of the elements in the figures may be exaggerated relative to other elements to help to improve understanding of embodiments of the present invention.

The method and structural components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION OF THE INVENTION

One aspect of this disclosure relates to an antenna, especially beneficial for use with a handheld radio frequency (RF) identification (RFID) reader for scanning RFID tags oriented in different orientations (e.g., vertical, horizontal, or slanted) in a controlled area. The antenna includes an RF signal feeding port located on an axis. The port supplies an RF signal in an operating band of frequencies. Advantageously, in the case of an RFID reader, the operating band of frequencies lies in a frequency range on the order of 902-928 MHz. This designated range is not intended to limit the invention disclosed herein, because other frequency ranges are also contemplated.

The antenna further includes a primary antenna member operatively connected to the port, and including an electrically conductive, first antenna element extending in a radial direction away from the axis and continuing along at least one turn in a turning direction at least partly about the axis, and an electrically conductive, second antenna element extending in an opposite radial direction away from the axis and continuing along at least one turn in the turning direction at least partly about the axis. The first and second antenna elements are rotationally symmetrically arranged about the axis, and are operative for conducting the RF signal along the primary antenna member, and for transmitting and receiving electromagnetic waves with a primary slant polarization having components in both of two mutually orthogonal planes (e.g., horizontal and vertical polarization planes). Advantageously, the primary slant orientation extends along a 45 degree direction relative to the horizontal and vertical directions so that the components are substantially equal. Thus, the reader is enabled to read any tag, no matter its orientation.

In one embodiment, each antenna element has a plurality of linear sections arranged in an end-to-end succession, one after another. Adjacent successive linear sections are generally perpendicular to each other. In another embodiment, each antenna element has a plurality of sections arranged in an end-to-end succession, and at least one of the sections is arcuate. To increase the antenna gain, it is desirable to juxtapose a secondary antenna member with the primary antenna member. The secondary antenna member reflects the electromagnetic waves propagated by the primary antenna member with a secondary slant polarization in a manner analogous to a Yagi antenna. The primary and the secondary slant polarizations are congruent.

A method of making and using an antenna, in accordance with another aspect of this disclosure, is performed by supplying an RF signal in an operating band of frequencies from a radio frequency (RF) port located on an axis; operatively connecting a primary antenna member to the port; extending an electrically conductive, first antenna element of the primary antenna member in a radial direction away from the axis and continuing along at least one turn in a turning direction at least partly about the axis; extending an electrically conductive, second antenna element of the primary antenna member in an opposite radial direction away from the axis and continuing along at least one turn in the turning direction at least partly about the axis; arranging the first and second antenna elements to be rotationally symmetrical about the axis; conducting the RF signal along the primary antenna member; and transmitting and receiving electromagnetic waves with a primary slant polarization having components in both of two mutually orthogonal planes.

Figure 1:
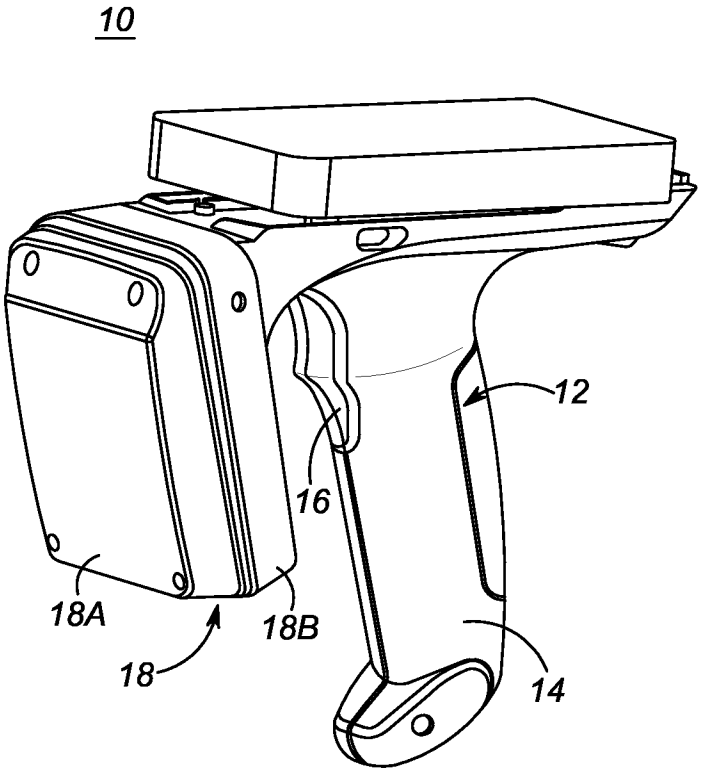
FIG. 1 is a perspective view of a handheld RFID reader and a reader radome containing a reader antenna in accordance with the present disclosure.

Turning now to FIGS. 1-2 of the drawings, reference numeral 10 generally identifies a handheld RFID reader for interrogating and reading RFID tags within its coverage range. This particular embodiment of the RFID reader 10 has a gun-shaped body 12 having a handle 14 to be gripped and held by a user, a trigger 16 to be manually actuated by the user to initiate reading, and a front-mounted radome 18 having housing parts 18A, 18B for containing therein an antenna (for example, see any of the different antenna embodiments respectively depicted in FIGS. 3A-3F, or the antenna embodiment of FIGS. 5-9) that is naturally pointed toward, and faces, each intended target tag during normal handheld operation of the RFID reader 10. The antenna transmits electromagnetic waves to each tag in its turn, and receives return electromagnetic waves from each tag, during operation. FIG. 2 depicts an antenna member 30, which is described in detail below in the discussion of the antenna embodiment of FIGS. 5-9, as seen if the outer housing part 18A were transparent.

The gun-shaped configuration of the reader 10 is merely exemplary, because the antenna can be deployed in any number of different reader configurations. Although not depicted in FIGS. 1-2, the reader 10 may also include a display, a keypad, a touch panel, other input/output elements, or the like. Also, the front deployment of the antenna in the radome 18 is merely exemplary, because the antenna can be deployed at other locations on the reader, for example, on the top or the bottom of the reader 10, or in a dock on which the reader is supported. In the exemplary application described herein, the antenna is designed to operate in the UHF frequency band designated for RFID systems. Alternate embodiments may instead utilize the high frequency band, or the low frequency band, designated for RFID systems. For example, in the United States, RFID systems may utilize the 902-928 MHz frequency band, and in Europe, RFID systems may utilize the 865-868 MHz frequency band. The antenna can be designed, configured, and tuned to accommodate the particular operating frequency band of the host RFID reader 10. In addition, the antenna described herein can also be used in non-RFID applications.

As described herein, one aspect of this invention is to make the antenna relatively smaller in size, relatively lighter in weight, relatively less expensive, and relatively less sensitive to the polarization of the tags being interrogated, as compared to the known antennas, without sacrificing good reading performance The antenna of this invention can accommodate the packaging requirements and configuration of existing RFID readers and/or can readily accommodate new readers. For the sake of brevity, conventional techniques related to RFID data transmission, RFID system architecture, RF signal processing, and other functional aspects of RFID systems (and the individual operating components of such systems) may not be described in detail herein.

Briefly stated, the RFID reader 10 conventionally includes, without limitation: an RF communication module coupled to, and driving, the antenna; a power supply (e.g., a battery pack); a processor; and a memory. The various operating components of the reader 10 are coupled together as needed to facilitate the delivery of operating power from the power supply, the transfer of data, the transfer of control signals and commands, and the like. The processor may be any general purpose microprocessor, controller, or microcontroller that is suitably configured to control the operation of the reader. In practice, the processor may execute one or more software applications that provide the desired functionality for the reader. The memory is capable of storing application software utilized by the processor and/or data captured by the reader during operation. The RF communication module is suitably configured to process RF signals associated with the operation of the reader, and to otherwise support the RFID functions of the reader. The communication module includes a transceiver that generates and transmits an RF interrogation signal to each tag via the antenna, and that receives a reflected RF payload signal generated by each tag via the antenna in response to the interrogation signal. The antenna is coupled to the RF communication module using RF transmission lines or RF coaxial cables in combination with suitable RF connectors, plugs, nodes, or terminals on the communication module and/or on the antenna.

Turning now to the various antenna embodiments of FIGS. 3A-3F, each antenna includes an RF signal feeding port located on an axis P. The port supplies an RF interrogation signal in an operating band of frequencies. Many different types of feed arrangements can be used. For example, any of the respective feeding arrangements of FIGS. 4A-4C, or the feeding arrangement of FIGS. 5-9, can be used, as described below. Each antenna embodiment in FIGS. 3A-3F includes a primary antenna member operatively connected to the port, and including an electrically conductive, generally planar, first antenna element extending in a radial direction away from the axis P and continuing along at least one turn in a turning direction at least partly about the axis P, and an electrically conductive, generally planar, second antenna element extending in an opposite radial direction away from the axis P and continuing along at least one turn in the turning direction at least partly about the axis P. The first and second antenna elements are rotationally symmetrically arranged about the axis P.

Figure 3A:
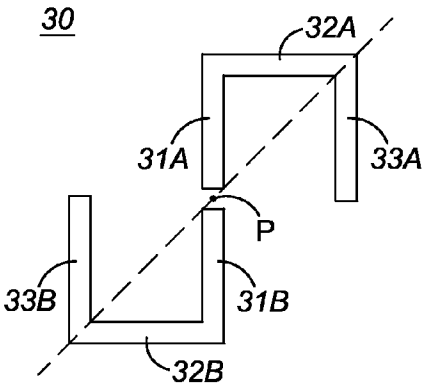
FIGS. 3A, 3B, 3C, 3D, 3E, and 3F are enlarged, top plan views of different embodiments of antennas that can be contained in the radome of FIG. 1.

More specifically, the primary antenna member 30 of FIG. 3A includes a first antenna element comprised of three linear sections 31A, 32A, and 33A arranged in an end-to-end succession, one after another. Adjacent successive linear sections 31A and 32A are generally perpendicular to each other in a first turn. Adjacent successive linear sections 32A and 33A are generally perpendicular to each other in a second turn. Linear sections 31A and 33A are generally parallel to each other. The primary antenna member 30 of FIG. 3A also includes a second antenna element comprised of three linear sections 31B, 32B, and 33B arranged in an end-to-end succession, one after another. Adjacent successive linear sections 31B and 32B are generally perpendicular to each other in a first turn. Adjacent successive linear sections 32B and 33B are generally perpendicular to each other in a second turn. Linear sections 31B and 33B are generally parallel to each other. Sections 31A and 31B are collinear and extend in opposite radial directions relative to the axis P. Sections 32A and 32B are generally parallel to each other. The antenna 30 generally has an S-shape.

Figure 3B:
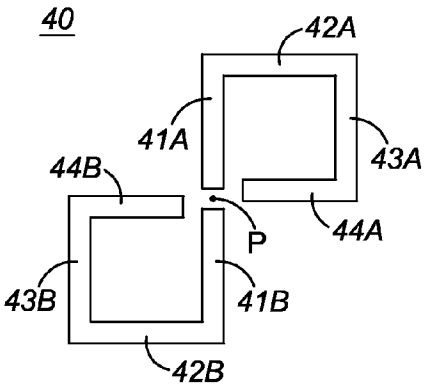

The primary antenna member 40 of FIG. 3B includes a first antenna element comprised of four linear sections 41A, 42A, 43A, and 44A arranged in an end-to-end succession, one after another. Adjacent successive linear sections 41A and 42A are generally perpendicular to each other in a first turn. Adjacent successive linear sections 42A and 43A are generally perpendicular to each other in a second turn. Adjacent successive linear sections 43A and 44A are generally perpendicular to each other in a third turn. Linear sections 41A and 43A are generally parallel to each other. Linear sections 42A and 44A are generally parallel to each other. Section 44A is shorter than section 42A. The primary antenna member 40 of FIG. 3B also includes a second antenna element comprised of four linear sections 41B, 42B, 43B, and 44B arranged in an end-to-end succession, one after another. Adjacent successive linear sections 41B and 42B are generally perpendicular to each other in a first turn. Adjacent successive linear sections 42B and 43B are generally perpendicular to each other in a second turn. Adjacent successive linear sections 43B and 44B are generally perpendicular to each other in a third turn. Linear sections 41B and 43B are generally parallel to each other. Section 44B is shorter than section 42B. Linear sections 42B and 44B are generally parallel to each other. Sections 41A and 41B are collinear and extend in opposite radial directions relative to the axis P. Sections 42A and 42B are generally parallel to each other.

Figure 3C:
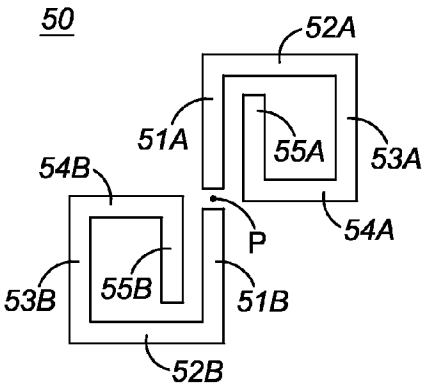

The primary antenna member 50 of FIG. 3C includes a first antenna element comprised of five linear sections 51A, 52A, 53A, 54A, and 55A arranged in an end-to-end succession, one after another. Adjacent successive linear sections 51A, 52A, 53A, 54A, and 55A are generally perpendicular to each other, in the manner described above, in successive turns. The primary antenna member 50 also includes a second antenna element comprised of five linear sections 51B, 52B, 53B, 54B, and 55B arranged in an end-to-end succession, one after another. Adjacent successive linear sections 51B, 52B, 53B, 54B, and 55B are generally perpendicular to each other, in the manner described above, in successive turns.

Figure 3D:
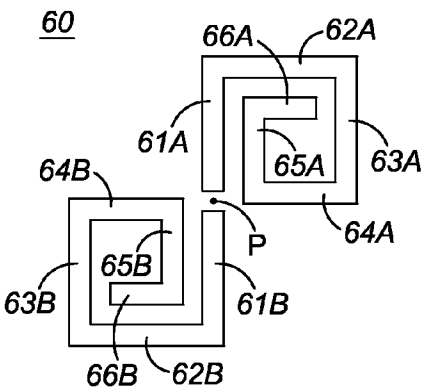

The primary antenna member 60 of FIG. 3D includes a first antenna element comprised of six linear sections 61A, 62A, 63A, 64A, 65A, and 66A arranged in an end-to-end succession, one after another. Adjacent successive linear sections 61A, 62A, 63A, 64A, 65A, and 66A are generally perpendicular to each other, in the manner described above, in successive turns. The primary antenna member 60 also includes a second antenna element comprised of six linear sections 61B, 62B, 63B, 64B, 65B, and 66B arranged in an end-to-end succession, one after another. Adjacent successive linear sections 61B, 62B, 63B, 64B, 65B, and 66B are generally perpendicular to each other, in the manner described above, in successive turns.

Figure 3E:
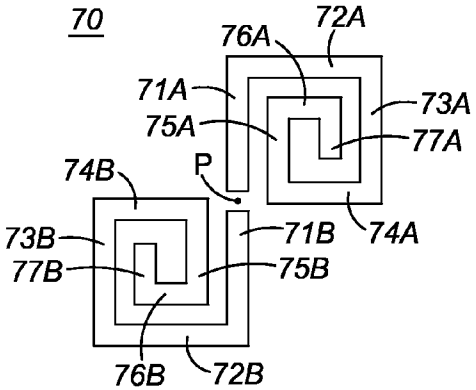
Figure 3F:
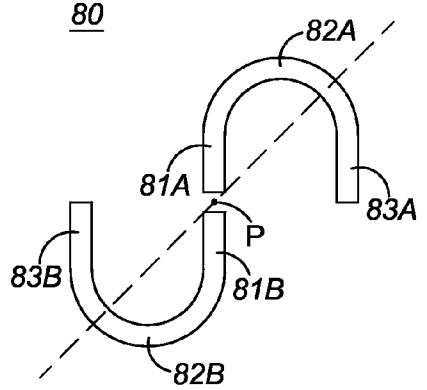

The primary antenna member 70 of FIG. 3E includes a first antenna element comprised of seven linear sections 71A, 72A, 73A, 74A, 75A, 76A, and 77A arranged in an end-to-end succession, one after another. Adjacent successive linear sections 71A, 72A, 73A, 74A, 75A, 76A, and 77A are generally perpendicular to each other, in the manner described above, in successive turns. The primary antenna member 70 also includes a second antenna element comprised of seven linear sections 71B, 72B, 73B, 74B, 75B, 76B, and 77B arranged in an end-to-end succession, one after another. Adjacent successive linear sections 71B, 72B, 73B, 74B, 75B, 76B, and 77B are generally perpendicular to each other, in the manner described above, in successive turns.

As shown in FIGS. 3A-3E, as more shorter and shorter sections are added, the first antenna element tends to spiral or coil in on itself in a stepwise meandering fashion along the turning direction (e.g., clockwise), and the second antenna element tends to spiral or coil in on itself in a corresponding stepwise meandering fashion along the same turning direction (i.e., clockwise). Of course, in other embodiments, the turning direction could be counterclockwise. Not all the sections need be linear; for example, the primary antenna member 80 of FIG. 3F includes a first antenna element comprised of three sections 81A, 82A, and 83A arranged in an end-to-end succession, one after another. Section 82A is arcuate and connects sections 81A and 83A. Sections 81A and 83A are generally parallel to each other. The primary antenna member 80 of FIG. 3F also includes a second antenna element comprised of three sections 81B, 82B, and 83B arranged in an end-to-end succession, one after another. Section 82B is arcuate and connects sections 81B and 83B. Sections 81B and 83B are generally parallel to each other. In addition, each antenna element can be shaped as a helix or spiral.

Each of the above-described primary antenna members 30, 40, 50, 60, 70 and 80 is a dipole operative for conducting the RF signal along the primary antenna member, and for transmitting and receiving electromagnetic waves with a primary slant polarization having components in both of two mutually orthogonal planes (e.g., horizontal and vertical polarization planes). Advantageously, as shown by the dashed line in FIG. 3A or in FIG. 3F, the primary slant orientation extends along a 45 degree direction relative to the horizontal and vertical directions so that the components are substantially equal. In the other antenna members of FIGS. 3B-3E, the primary slant orientation is not exactly 45 degrees, but is angularly offset by a few degrees. Nevertheless, the reader 10 is enabled to read any tag, no matter its orientation.

Figure 4C:
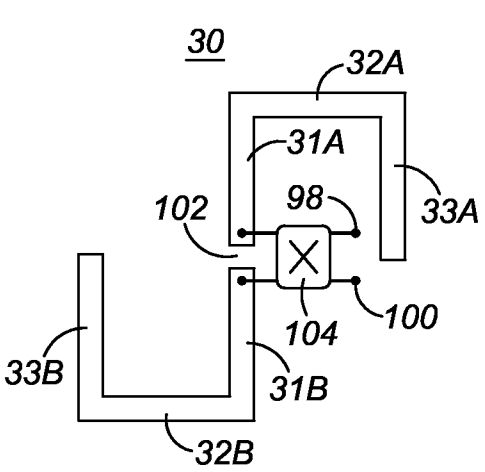
FIGS. 4A, 4B, and 4C are different embodiments of RF signal feed arrangements for the representative antenna of FIG. 3A.
Figure 4B:
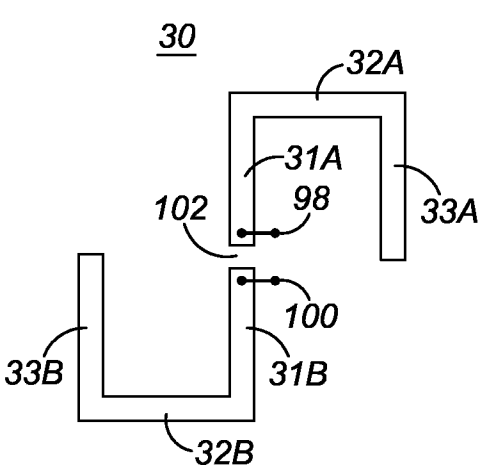
Figure 4A:
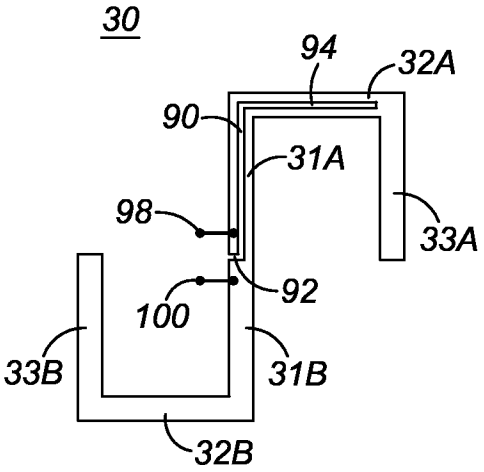

As stated above, FIGS. 4A-4C depict different RF signal feeding arrangements, all shown for the primary antenna member 30 as a representative for all the other primary antenna members. FIG. 4A depicts a slot 90 extending through sections 31A and 32A. The slot 90 has an open end 92 and a shorted end 94. Input terminals 98, 100 are connected to the first and second antenna elements. The input terminals 98, 100 are connected to transmission lines that, in turn, are connected to the transceiver in the reader 10. An embedded balun implemented with the slot 90 shares the input terminals 98, 100. FIG. 4B depicts a gap feed, wherein the input terminals 98, 100 are connected to the first and second antenna elements across a gap 102. FIG. 4C depicts another gap feed, wherein the input terminals 98, 100 are connected to the first and second antenna elements through a balun 104 across the gap 102.

Figure 5:
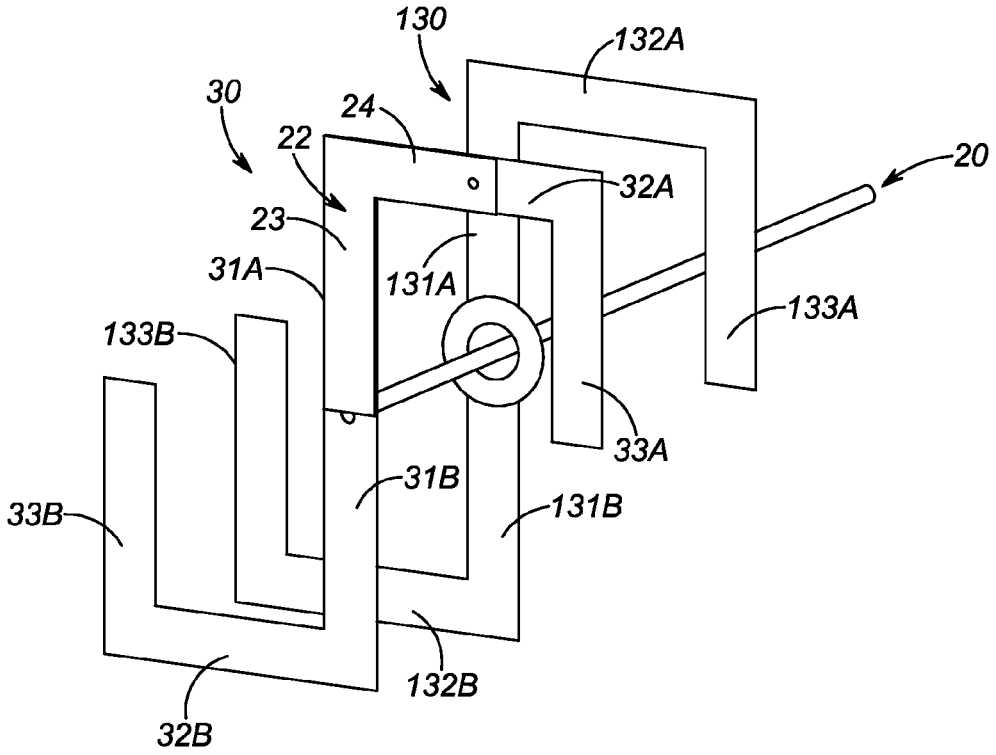
FIG. 5 is an enlarged perspective view of the antenna of FIG. 2, showing another embodiment of a signal feed arrangement.
Figure 6:
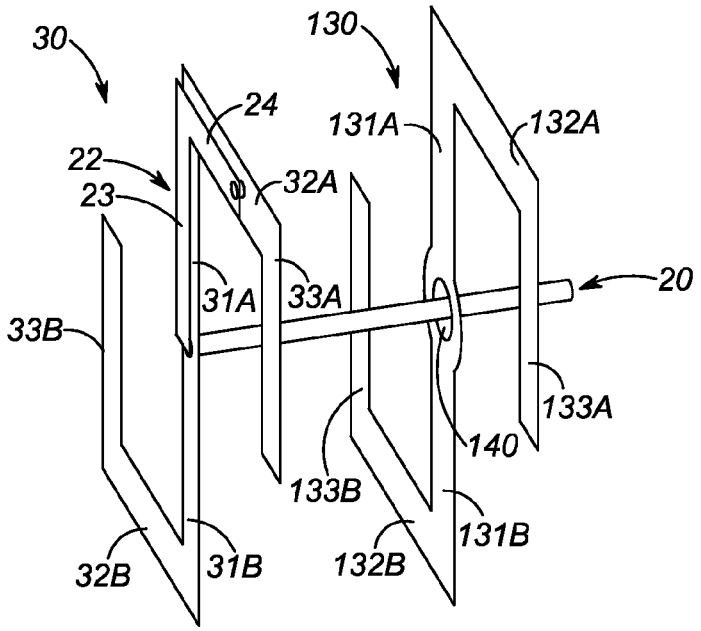
FIG. 6 is another perspective view analogous to FIG. 5.
Figure 7:
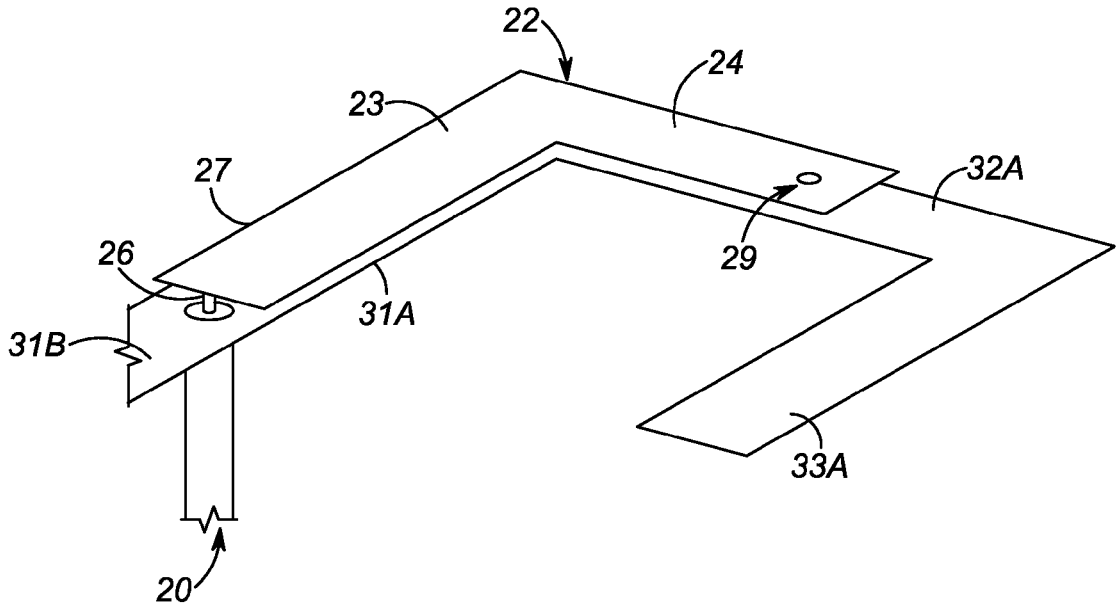
FIG. 7 is a broken-away, enlarged, perspective view of a detail of FIG. 5.
Figure 8:
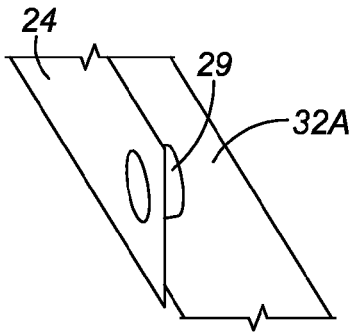
FIG. 8 is a broken-away, enlarged, perspective view of a detail of FIG. 7.

To increase the antenna gain, it is desirable to juxtapose a secondary antenna member with the primary antenna member. The secondary antenna member reflects the electromagnetic waves propagated by the primary antenna member with a secondary slant polarization that is congruent to the primary slant polarization in a manner analogous to a Yagi antenna. Thus, using the primary antenna member 30 as a representative for any of the other disclosed primary antenna members 40, 50, 60, 70 and 80, as shown in FIGS. 2, 5 and 6, a generally planar, S-shaped secondary antenna member 130 is spaced generally parallel to, and rearwardly of, the generally planar, S-shaped primary antenna member 30 by a spacing of about a quarter wavelength or less as measured at a center frequency in the operating band. The secondary antenna member 130 includes a first antenna element comprised of three linear sections 131A, 132A, and 133A arranged in an end-to-end succession, one after another. Adjacent successive linear sections 131A and 132A are generally perpendicular to each other in a first turn. Adjacent successive linear sections 132A and 133A are generally perpendicular to each other in a second turn. Linear sections 131A and 133A are generally parallel to each other. The secondary antenna member 130 also includes a second antenna element comprised of three linear sections 131B, 132B, and 133B arranged in an end-to-end succession, one after another. Adjacent successive linear sections 131B and 132B are generally perpendicular to each other in a first turn. Adjacent successive linear sections 132B and 133B are generally perpendicular to each other in a second turn. Linear sections 131B and 133B are generally parallel to each other. Sections 131A and 131B are collinear and extend in opposite radial directions relative to the axis P. Sections 132A and 132B are generally parallel to each other. The first and second antenna elements of the secondary antenna member 130 are rotationally symmetrical about the axis P.

To simplify the drawings, the primary antenna member 30 and the secondary antenna member 130 have been illustrated without their supporting dielectric substrates. In a variant construction as shown in FIG. 2, the primary antenna member 30 can be printed and supported on the interior surface of the outer housing part 18A, and the secondary antenna member 130 can be printed and supported on the interior surface of the other housing part 18B. Electromagnetic waves can pass through the housing parts of the radome 18.

As stated above, FIGS. 5-9 depict another RF signal feeding arrangement, shown for the primary and secondary antenna members 30, 130 as a representative example. The feeding arrangement includes a feed line 20 and an L-shaped, microstrip circuit 22 having a linear section 23 that is juxtaposed with the linear section 31A of the primary antenna member 30, and a linear section 24 that is juxtaposed with the linear section 32A of the primary antenna member 30. The electrical length of the linear sections 23 and 24 is about a quarter of a wavelength or less at the center frequency of the operating band. To simplify the drawings, the microstrip circuit 22 has been illustrated without its supporting dielectric substrate.

Figure 9:
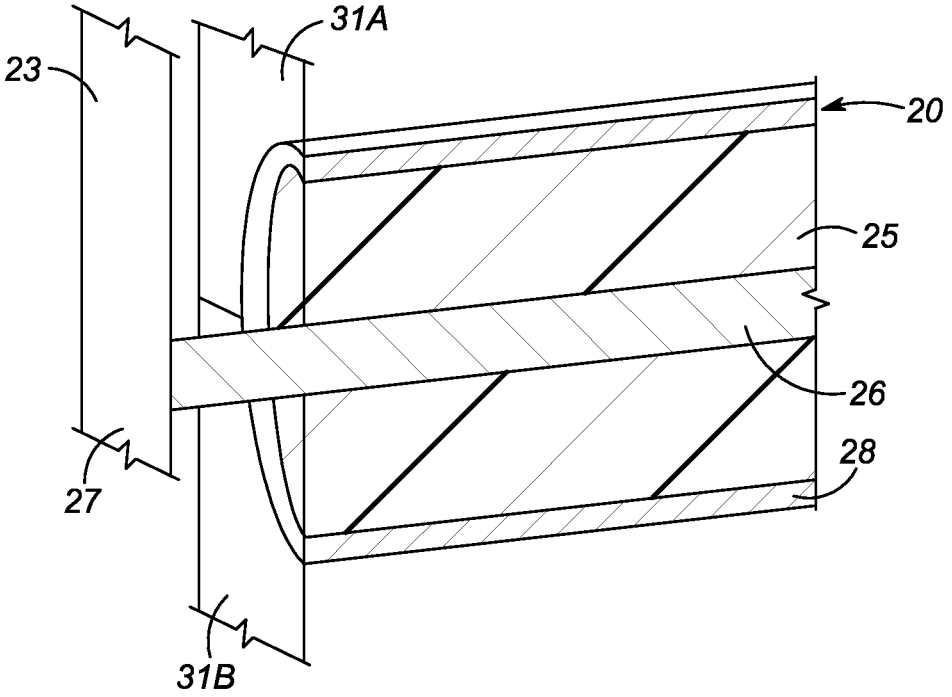
FIG. 9 is a broken-away, enlarged, perspective view of another detail of FIG. 7.

As best seen in FIG. 9, the feed line 20 includes an electrically insulating component or dielectric 25, e.g., constituted of Teflon, an electrical center metal conductor 26 extending through the insulating component 25 and electrically connected to an open end region 27 of the microstrip circuit 22, an electrically conductive sheath 28 electrically connected to the primary antenna member, and a shorted connection 29 for shorting an opposite end region of the microstrip circuit 22 to the primary antenna member. As best seen in FIG. 6, the feed line 20 passes through the secondary antenna member with a clearance 140 and is electrically isolated therefrom. The floating secondary antenna member 130 thus has an increased isolation with the feed line 20. Evidently, in this feeding arrangement, the center conductor 26, the dielectric 25, and the conductive sheath 28 form a coaxial cable.

By way of non-limiting numerical example, the S-shaped primary antenna member of FIG. 3A occupies a square area of 55 mm by 55 mm, which is much smaller than the square area of 115 mm by 115 mm occupied by a slanted dipole. The S-shaped primary antenna member of FIG. 3A weighs about 20 grams, which is much lighter than the 160 grams typically characteristic of a circularly polarized patch antenna. The S-shaped primary antenna member of FIG. 3A has a larger bandwidth than the other disclosed antenna members, and has a vertical-to-horizontal ratio of 1:1. Adding the secondary antenna member increases the depth to about 30 mm, thereby configuring the antenna to fit in a compact volume.

In the foregoing specification, specific embodiments have been described. However, one of ordinary skill in the art appreciates that various modifications and changes can be made without departing from the scope of the invention as set forth in the claims below. For example, any of the disclosed antenna members can be angularly turned from their illustrated orientations in either the clockwise or the counterclockwise directions. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has," "having," "includes," "including," "contains," "containing," or any other variation thereof, are intended to cover a non-exclusive inclusion, such that a process, method, article, or apparatus that comprises, has, includes, contains a list of elements does not include only those elements, but may include other elements not expressly listed or inherent to such process, method, article, or apparatus. An element proceeded by "comprises . . . a," "has . . . a," "includes . . . a," or "contains . . . a," does not, without more constraints, preclude the existence of additional identical elements in the process, method, article, or apparatus that comprises, has, includes, or contains the element. The terms "a" and "an" are defined as one or more unless explicitly stated otherwise herein. The terms "substantially," "essentially," "approximately," "about," or any other version thereof, are defined as being close to as understood by one of ordinary skill in the art, and in one non-limiting embodiment the term is defined to be within 10%, in another embodiment within 5%, in another embodiment within 1%, and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

It will be appreciated that some embodiments may be comprised of one or more generic or specialized processors (or "processing devices") such as microprocessors, digital signal processors, customized processors, and field programmable gate arrays (FPGAs), and unique stored program instructions (including both software and firmware) that control the one or more processors to implement, in conjunction with certain non-processor circuits, some, most, or all of the functions of the method and/or apparatus described herein. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used.

Moreover, an embodiment can be implemented as a computer-readable storage medium having computer readable code stored thereon for programming a computer (e.g., comprising a processor) to perform a method as described and claimed herein. Examples of such computer-readable storage mediums include, but are not limited to, a hard disk, a CD-ROM, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory) and a Flash memory. Further, it is expected that one of ordinary skill, notwithstanding possibly significant effort and many design choices motivated by, for example, available time, current technology, and economic considerations, when guided by the concepts and principles disclosed herein, will be readily capable of generating such software instructions and programs and ICs with minimal experimentation.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separately claimed subject matter.

The invention claimed is:

1. An antenna, comprising:

a radio frequency (RF) signal feeding port located on an axis, and operative for supplying an RF signal in an operating band of frequencies;

a primary antenna member operatively connected to the port, and including an electrically conductive, first antenna element extending in a radial direction away from the axis and continuing along at least one turn in a turning direction at least partly about the axis, and an electrically conductive, second antenna element extending in an opposite radial direction away from the axis and continuing along at least one turn in the turning direction at least partly about the axis, the first and second antenna elements being rotationally symmetrically arranged about the axis, and being operative for conducting the RF signal along the primary antenna member, and for transmitting and receiving electromagnetic waves with a primary slant polarization having components in both of two mutually orthogonal planes; and, a secondary antenna member juxtaposed with the primary antenna member, the secondary antenna member including an electrically conductive, third antenna element extending in the radial direction away from the axis and continuing along at least one turn in the turning direction at least partly about the axis, and an electrically conductive, fourth antenna element extending in the opposite radial direction away from the axis and continuing along at least one turn in the turning direction at least partly about the axis, the third and fourth antenna elements being rotationally symmetrically arranged about the axis, and being operative for re-radiating the electromagnetic waves propagated by the primary antenna member with a secondary slant polarization having components in both of the two mutually orthogonal planes, the primary and secondary slant polarizations being congruent, the port including a feed line and a microstrip circuit that is partly juxtaposed with the primary antenna element, the feed line including an electrically insulating component, an electrical conductor extending through the insulating component and electrically connected to one end region of the microstrip circuit, an electrically conductive sheath connected to the primary antenna element, and a shorted connection for shorting an opposite end region of the microstrip circuit to the primary antenna element.

2. The antenna of claim 1, wherein each antenna element is planar and lies in a common plane respective to each of the primary antenna member and the secondary antenna member.

3. The antenna of claim 1, wherein each antenna element has a plurality of linear sections arranged in succession, and wherein adjacent successive sections are generally perpendicular to each other.

4. The antenna of claim 1, wherein each antenna element has a plurality of sections arranged in succession, and wherein at least one of the sections is arcuate.

5. The antenna of claim 1, wherein the feed line passes through the secondary antenna member with clearance and is electrically isolated therefrom.

6. The antenna of claim 1, wherein the operating band is in a frequency range on the order of 902-928 MHz to accommodate a handheld RF identification (RFID) reader for scanning tags oriented in different orientations in a controlled area with respect to the mutually orthogonal planes.

7. The antenna of claim 1, wherein the slant orientation has substantially equal components in both the mutually orthogonal planes.

8. A method of making and using an antenna, comprising:

supplying an RF signal in an operating band of frequencies from a radio frequency (RF) port located on an axis;

operatively connecting a primary antenna member to the port;

extending an electrically conductive, first antenna element of the primary antenna member in a radial direction away from the axis and continuing along at least one turn in a turning direction at least partly about the axis;

extending an electrically conductive, second antenna element of the primary antenna member in an opposite radial direction away from the axis and continuing along at least one turn in the turning direction at least partly about the axis;

arranging the first and second antenna elements to be rotationally symmetrical about the axis;

juxtaposing a secondary antenna member with the primary antenna member, and configuring the secondary antenna member to include an electrically conductive, third antenna element extending in the radial direction away from the axis and continuing along at least one turn in a turning direction at least partly about the axis, and an electrically conductive, fourth antenna element extending in an opposite radial direction away from the axis and continuing along at least one turn in the turning direction at least partly about the axis, and arranging the third and fourth antenna elements to be rotationally symmetrical about the axis, and the secondary antenna member re-radiating electromagnetic waves propagated by the primary antenna member with a secondary slant polarization having components in both of the mutually orthogonal planes, and configuring the primary and the secondary slant polarizations to be congruent;

configuring the port to include a feed line and a microstrip circuit partly juxtaposed with the primary antenna element, and configuring the feed line to include an electrically insulating component, an electrical conductor extending through the insulating component and electrically connected to one end region of the microstrip circuit, an electrically conductive sheath and connected to the primary antenna element, and a shorted connection for shorting an opposite end region of the microstrip circuit to the primary antenna element;

conducting the RF signal along the primary antenna member; and transmitting and receiving the electromagnetic waves with a primary slant polarization having components in both of two mutually orthogonal planes.

9. The method of claim 8, and configuring each antenna element to be planar and to lie in a common plane respective to each of the primary antenna member and the secondary antenna member.

10. The method of claim 8, and configuring each antenna element to have a plurality of linear sections arranged in succession, and configuring adjacent successive sections to be generally perpendicular to each other.

11. The method of claim 8, and configuring each antenna element to have a plurality of sections in succession, and configuring at least one of the sections to be arcuate.

12. The method of claim 8, and passing the feed line through the secondary antenna member with clearance and in electrical isolation therefrom.

13. The method of claim 8, and configuring the operating band to be in a frequency range on the order of 902-928 MHz to accommodate a handheld RF identification (RFID) reader for scanning tags oriented in different orientations in a controlled area with respect to the mutually orthogonal planes.

14. The method of claim 8, and configuring the primary slant orientation to have substantially equal components in both the mutually orthogonal planes.

* * * * *